United States Patent [19]

Horn et al.

[11] Patent Number: 4,654,933

[45] **Date of Patent: * Apr. 7, 1987**

[54] GIN LINT CLEANER WITH FIBER RETURN

[75] Inventors: James L. Horn, Horn and Gladden, P.O. Box 64720, Lubbock, Tex. 79464; Robert C. Schwartz; John E. Sparks, both of Lubbock, Tex.

[73] Assignee: James L. Horn, Lubbock, Tex.

[ * ] Notice: The portion of the term of this patent subsequent to Jul. 16, 2002 has been disclaimed.

[21] Appl. No.: 727,390

[22] Filed: Apr. 25, 1985

Related U.S. Application Data

[62] Division of Ser. No. 566,393, Dec. 28, 1983, Pat. No. 4,528,725.

[51] Int. Cl.[4] ..... D01B 1/04; D01G 9/06

[52] U.S. Cl. ..... 19/200; 19/39; 19/107; 19/202

[58] Field of Search ..... 19/39, 200, 64.5, 65 A, 19/202, 107

[56] References Cited

U.S. PATENT DOCUMENTS

| | | | |
|---|---|---|---|
| Re. 23,044 | 10/1948 | Brooks | 19/203 |
| 2,014,673 | 9/1935 | Setzer | 19/99 |
| 2,747,235 | 5/1956 | Wallace | 19/203 |
| 2,879,549 | 3/1959 | Miller et al. | 19/98 X |
| 3,081,499 | 3/1963 | Goldman | 19/99 |
| 3,118,185 | 1/1964 | Caille | 19/114 |
| 3,604,062 | 9/1971 | Hollingsworth | 19/113 |
| 4,126,914 | 11/1978 | Winch et al. | 19/104 X |
| 4,219,908 | 9/1980 | Winch et al. | 19/104 X |
| 4,355,439 | 10/1982 | Estebanell | 19/107 |
| 4,400,852 | 8/1983 | Löffler | 19/107 |

OTHER PUBLICATIONS

"Experimental Dual Saw Lint Cleaner", by Roy V. Baker, A.S.A.E. Jun. 24–27, 1984, Paper No. 84–3053.

Annual Report, FY 1984, USDA, Cotton and Gin Research Laboratory, Lubbock, Texas.

*Primary Examiner*—Louis K. Rimrodt

*Attorney, Agent, or Firm*—Montgomery W. Smith; Wendell Coffee

[57] ABSTRACT

A cotton gin lint cleaner includes a rotating saw cylinder. A continuous layer of lint cotton is fed along the cylinder by feed works. The layer is seated in and moved downstream by saw teeth on the cylinder. Foreign matter is loosened from the layer as it is moved beneath grid bars spaced along the cylinder surface. A combing bar downstream of the grid bars with teeth opposed and proximate the saw teeth further cleans the cotton layer.

6 Claims, 10 Drawing Figures

GIN LINT CLEANER WITH FIBER RETURN

CROSS REFERENCE TO RELATED APPLICATIONS

This is a divisional application, as defined at MoPEP 201.06, of a copending parent application, Ser. No. 566,393 filed Dec. 28, 1983, now U.S. Pat. No. 4,528,725, granted July 16, 1985. This application claims an invention not claimed in the parent application, and is filed by the applicants of the parent application. The Specification which follows, and the drawings enclosed herewith, duplicate those of the parent application, and do not introduce new matter. The subject matter claimed herein is based on that disclosure and is entitled to an effective filing date of Dec. 28, 1983 under 35 USC 120.

BACKGROUND OF THE INVENTION (1) Field of the Invention

This invention relates to cleaning foreign matter from lint cotton in a gin.

(2) Description of the Prior Art

In harvesting, seed cotton is stripped or picked from the plant, deposited in a trailer or other vehicle, and transported to a cotton gin. The cotton gin has apparatus for receiving the seed cotton, removing the seeds, cleaning the lint cotton, and pressing the lint into bales for transport to textile mills or compresses for further processing. Cotton gins are ordinarily close to the points of harvest, far from centralized textile mills.

Cotton gins ordinarily do not process lint cotton on a continuous basis. Therefore, the lint cleaner and all other gin equipment must have sufficient capacity to handle peak loads and avoid bottlenecks. A minimum rate for ginning capacity of all gin equipment is about 3,000 pounds of lint cotton per hour. A gin preferably has peak capacity substantially about 4,000 pounds per hour. Historically, the capacity of gins has risen steadily due to improvements in processing methods and equipment.

Prior to our invention, trash or foreign matter in cotton lint presented significant problems to cotton producers. This was especially true of stipper cotton, which contained more bark and leaf trash or foreign matter than picked cotton. For example, in the area of the South Plains of Texas with which we are most familiar, cotton farmers lost an estimated $50,000,000 in 1982 due to price penalties suffered for high trash content in stripper cotton.

Most lint cotton leaving a gin stand will have a minimum of 5% foreign matter content. Although lint cleaners previously employed in cotton gins removed a significant amount of trash, they were almost never able to clean gin lint below 1% foreign matter content, and typically unable to clean gin lint to less than 2% foreign matter content.

Thus, it may be seen that a great need exists for a cotton gin lint cleaner that will satisfactorily clean lint cotton having greater than 5% foreign matter content at rates greater than 4,000 pounds of lint cotton per hour. Although conventional lint cleaners might be arranged in series, or other wise conventionally disposed, to attempt to achieve this goal, experience in the industry has shown that unacceptable fiber damage results.

Applicants are aware of the following United States patents:

SETZER, U.S. Pat. No. 2,014,673
MILLER ET AL, U.S. Pat. No. 2,879,549
GOLDMAN, U.S. Pat. No. 3,081,499
HOLLINGSWORTH, U.S. Pat. No. 3,604,062
WINCH ET AL, U.S. Pat. No. 4,126,914
WINCH ET AL, U.S. Pat. No. 4,219,908

WINCH ET AL '914 discloses a textile mill lint cleaner having a train of rolls with each roll in the train rotating counter to and faster than the preceding roll in the train. The tooth density of each succeeding roll in the train increases substantially over that of the preceding roll. The WINCH ET AL '914 apparatus is disclosed for use in a textile mill, with cards on the rolls having 560 teeth per square inch. WINCH ET AL '914 states at column 10, lines 23–26, that "the treatment unit herein described is capable of producing over 400 pounds and up to 700 pounds or more per hour of a high quality cotton web." This is much less than cotton gin processing requirements of 4,000 pounds or more per hour.

Applicant's believe the Examiner would regard the other patents as pertinent background information.

SUMMARY OF THE INVENTION (1) New Functions and Surprising Results

We have invented a cotton gin lint cleaner that solves the problems identified above with regard to cleaning gin lint. In describing the saw cylinders herein, it will be understood that each rotates about an axis, with teeth thereon being inclined in the direction of tooth movement during rotation. Various cleaning devices are positioned adjacent and along the cylinders, parallel the axes.

In describing the positions of structure along the saw cylinder, it will be understood that the term "downstream" means "in the direction of tooth or lint layer movement from another reference position". The term "downstream" also refers to the movement of the layer as it follows its path through the lint cleaner or cotton gin.

Grid, or mote, bars are well-known in the cotton ginning art. Grid bars in the prior art were placed along a saw cylinder, with edges of the grid bars in close proximity to the saw teeth. Our invention combines grid bars with a combining bar to produce unusual and surprising results.

The combing bar preferably has teeth opposite the saw teeth of the cylinders. The saw cylinder teeth are inclined in their direction of movement. The teeth on the combing bar are inclined opposite those of the saw cylinder, or against the saw tooth movement. We also prefer to mount a trash knife, or grid bar mounted on the combing bar, immediately upstream of the combing teeth.

The layer is moved quickly beneath and past the grid and combing bars. The grid bars provide a linear or lengthwise disturbance of the cotton fibers seated on the saw cylinder, while the combing teeth provide point disturbances of this cotton fiber layer. These disturbances of the cotton layer loosen trash therefrom.

We are able to convert existing, single saw cylinder, lint cleaners by adding a combing bar and utilizing the increased cleaning effect of the existing grid bars in combination with the combing bar to better clean lint cotton therethrough.

We have also discovered that the cleaning effectiveness of our combing bar and the grid bars is enhanced when used on two or more adjacent counter-rotating saw cylinders. With two such cylinders, the layer is inverted during transfer from the upstream saw cylinder to the downstream cylinder across a saw pinch.

It may be seen that the flat layer of lint cotton has two surfaces or boundaries while on the saw cylinders: one surface facing toward the cylinder, and another surface facing away from the cylinder. When the layer is transferred to the downstream cylinder, the layer, and its surfaces, are inverted, so that the surface previously facing toward the upstream cylinder will face away from the downstream cylinder. Thus, grid or combing bars positioned along both cylinders will clean both surfaces of the layers.

The transfer between cylinders raises significant problems not satisfactorily solved in the prior art. We found that at most cylinder rotational speeds, the transfer of the cotton layer from one saw cylinder to an adjacent counter and faster rotating follow saw cylinder is incomplete. We also found that the portion of the layer that was transferred to an adjacent cylinder was not sufficiently seated to permit the effective utilization of grid bars.

We have discovered that a cylinder tooth speed ratio of about 1 to 1.3 between an upstream cylinder and a faster counter-rotating downstream cylinder achieves almost complete disengagement of lint fibers from the upstream cylinder. However, a portion of the cotton layer is often not retained on the downstream cylinder teeth. We solve this problem by placing a curved deflector along the follow cylinder just downstream of the saw pinch to form a downstream-tapered transfer chamber. The deflector deflects or directs the disengaged layer toward the downstream cylinder teeth.

To permit the use of grid bars on the downstream saw cylinders, we seat the layer with a seating bar. As inclined seating face on the bar has an upstream edge that is spaced proximate but away from the saw teeth, and has a downstream edge that is abutted against the saw teeth. The saw teeth cut their own clearance in the face material at the downstream edge, thereby insuring that the cotton lint fibers passing beneath the face are pushed or seated as far down on the teeth as feasible. The relatively low tooth density (48 to 72 points per square inch) and relatively large tooth size (6 teeth per inch of saw band at a forward inclined angle of about 36°) contribute to the effectiveness of seating substantial amounts of cotton on the teeth (more than 1.0 pound of lint per minute per inch of cylinder length).

We prefer to use at least one, and most preferably three, blunt or round bars between the deflector and the seating bar. Each blunt bar has a blunt face spaced more proximate the saw teeth than the blunt face or deflector downstream edge immediately upstream therefrom. The blunt bars offer minimal resistance and less fiber damage to the layer, and still force the layer further onto the teeth in preparation for final seating by the seating bar.

Therefore, our invention accomplishes the unexpected and surprising results of cleaning foreign matter from cotton gin lint to a substantially greater extent than heretofore feasible, at high flow rates, while transferring a cotton layer between cylinders to enable utilization of grid and combing bars with our novel combination of cylinders, saw bands, bars, plates and the like.

Of course, if additional cleaning is required, more than two cylinders may be employed in series, with similar transfer methods and apparatus between cylinders as described above.

For added cleaning, however, we prefer to retain the two saw cylinder lint cleaner, and to increase its cleaning efficiency by using a larger diameter downstream cylinder, and by installing more grid and combing bars on the greater available peripheral area thereof.

Thus it may be seen that the function of the total combination far exceeds the sum of the functions of the individual elements, such as bars, teeth, cylinders, etc.

(2) Objects of this Invention

An object of this invention is to remove foreign matter from gin lint.

Further objects are to achieve the above with a device that is sturdy, compact, durable, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings.

Figure 1:
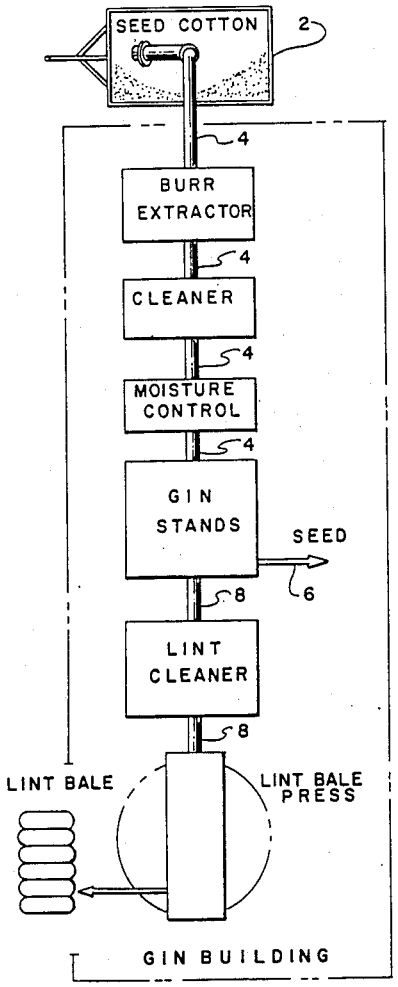
FIG. 1 is a schematic diagram of the steps and structure of a typical cotton gin, showing the lint cleaner receiving lint cotton from the gin stands.

DESCRIPTION OF THE PREFERRED EMBODIMENTS:

FIG. 1 schematically describes a typical cotton gin process flow in which applicants' invention is preferably employed. Seed cotton is harvested in the field and transported to the location of the cotton gin building in trailers 2 or other vehicles. At the gin, seed cotton handling system 4 receives the seed cotton and transports it to devices for removing green bolls from the seed cotton, controlling the moisture content of the seed cotton, and cleaning and extracting some foreign matter from the seed cotton, shown in FIG. 1 as "burr extractor", "cleaner" and "moisture control".

"Foreign matter" or "trash" refers to the cotton plant stalks, stems, leaves, bark, and boll pieces normally found in cotton delivered from the harvest site to a cotton gin. Foreign matter also may include small pebbles, dirt, sand, weeds, seeds and other trash picked up by harvesting equipment.

The seed cotton is fed to one or more gin stands, where the seeds are separated from the lint cotton. The seeds are transported by seed handling system 6 to further processing or to storage for shipment.

The lint cotton is transported from the gin stands by lint handling system 8 to a lint cleaner. Although some foreign matter may be removed before the seed cotton is transported to the gin stands, as described above, the lint cotton leaving the gin stands still contains substantial amounts of foreign matter, in almost any case in cotton gins, greater than five percent by weight.

The lint cotton is transported or conveyed from the lint cleaner to a packaging system, or press means, for compressing the lint cotton into dense bales. A typical press means consists of a condenser, lint slide, feeder, tramper, bale press, and strapping bale tying machine, shown in FIG. 1 as "lint bale press". The lint cotton emerges from the press means as a dense, somewhat rectangular lint cotton bale held together with wire ties, and weighing about 480 to 500 pounds. The bales are then shipped to compresses or to textile mills for further processing. The gin building preferably encloses the gin equipment described above under a roof at one location.

The seed cotton handling system 4 forms receiver means for receiving seed cotton into the gin building, and forms transport means for transporting the received seed cotton to the gin stands. The gin stands form gin stand means for separating lint fibers from seeds of the seed cotton. The lint handling system 8 forms conveyor means for conveying or transporting the lint cotton fibers from the gin stands to the lint cleaner, and from the lint cleaner to the lint bale press. The lint bale press forms press means for pressing or compressing the lint cotton into a dense bale.

Referring to FIGS. 2 through 6, one preferred embodiment of a lint cleaner according to our invention includes first or upstream saw cylinder 10 journaled or mounted to frame 12 for rotation about a first or upstream axis. Surface 14 of the first saw cylinder 10 extends axially and radially of the first axis. A plurality of saw teeth 16 are attached to and spaced over the first cylinder surface 14.

First or upstream drive belt 18 connecting a motor (not shown) to first drive pulley 20 axially attached to the first saw cylinder 10 form first or upstream drive means for rotating the first cylinder 10 about the first axis. The first cylinder is preferably rotated so that the saw teeth 16 have a tangential speed of about 5,000 feet per minute.

The saw teeth 16 are preferably in the form of a toothed saw band 17 spirally wrapped about the first cylinder surface 14. The teeth are oriented or inclined in the direction of tooth movement when the first cylinder is rotated by the first drive means. We also prefer to use a tooth spacing or density of about 48 to 72 tooth points per square inch. This density is accomplished in preferred practice by using saw bands having six teeth per inch and wrapping the bands about the cylinder such that there are 8 to 12 wraps per axial or longitudinal inch of the cylinder.

Figure 7:
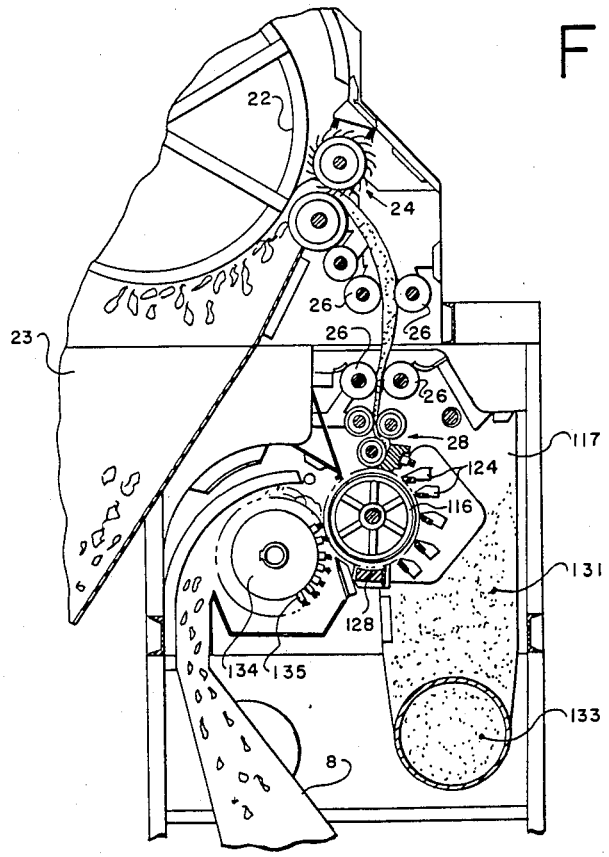
FIG. 7 is a side section view of a second embodiment of our invention having a single saw cylinder, and showing typical prior art feed works.

We prefer to employ standard feed works as known in the art to function as feed means for feeding a substantially continuous batt or layer of lint cotton along the first saw cylinder 10. One example of such feed works is shown in FIG. 7, where condenser 22 collects lint cotton from intake duct 23, connected to the lint handling system 8, which air flows lint from the gin stands to the intake duct 23. Doffing assembly 24 removes the collected lint from the condenser 22 and feeds it in position to be compressed into a batt or layer of lint cotton between compression rollers 26. The layer is directed by the compression rollers to feed assembly 28.

The feed assembly 28 is part of the feed works, and also forms feed means for feeding a substantially continuous layer of lint along the first cylinder 10.

It will be understood that other feed works and feed assemblies could be used in conjunction with our invention, so long as a substantially continuous batt or layer of cotton is fed to and seated on the first cylinder teeth.

For clarity, only the feed assembly of the feed works is shown in FIGS. 2, 8, 9, and 10. Likewise, much of the structure shown in FIGS. 2, 7, and 8, such as the sheet metal walls forming trash disposal and air flow control ducts, the lint cleaner frame, and brackets for mounting blunt bars, seating bars, grid bars, and combing bars, are not shown in some Figures for clarity. Those skilled in the art, however, will be able to supply the necessary frame, covers, baffles, ductwork, mounting brackets and other omitted structure based on the disclosure herein and knowledge of the gin lint cleaning art. Reference may be had to FIG. 7 for the preferred feed works and some other structure not shown in FIGS. 2, 8, 9 and 10.

With regard to all of the drawings, it will be understood that the arrows inside each cylinder represent the direction of rotation of that cyliner, and hence the direction of movement of teeth or other structure attached thereon. Arrows outside the cylinders represent the direction of flow of trash and foreign matter, air flow, or the movement of lint cotton, as appropriate.

Figure 2:
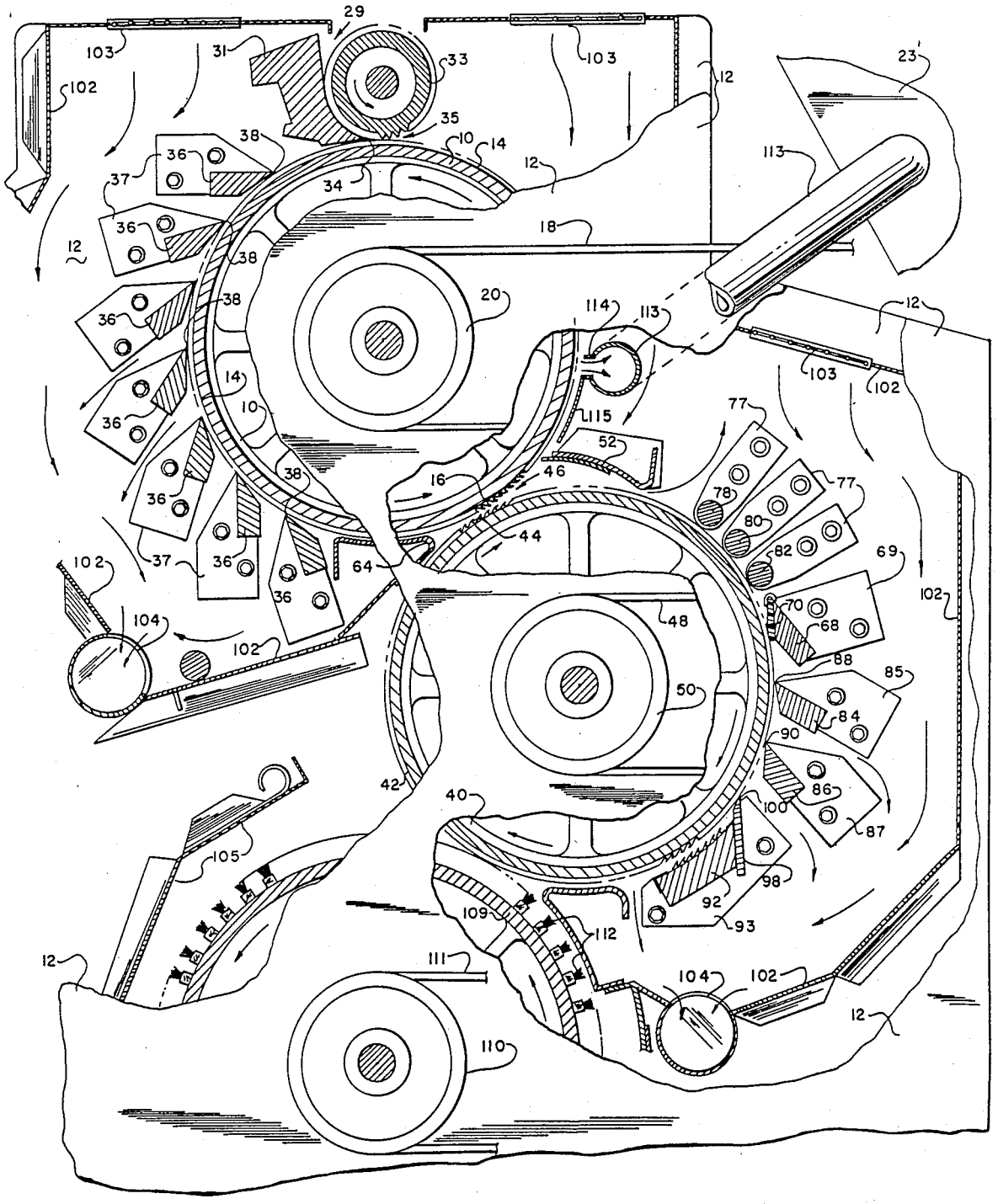
FIG. 2 is a side elevation view of a cotton gin lint cleaner having two saw cylinders according to our invention, with much of the frame broken away and the internal parts shown in cross-ection.

Referring to FIG. 2, feed assembly 29 provides means for feeding the substantially continuous layer of lint cotton along the first cylinder surface 14 across feed pinch 35 between the first cylinder and feed plate 31 and roller 33. The functioning of the preferred feed assembly in seating the layer of lint cotton on the first cylinder teeth 16 will be described later. The feed assembly is preferably journaled and rigidly connected to the frame 12 such that a fixed clearance between the feed plate 31, feed roller 33, and the saw teeth 16 is maintained.

In order for the lint cleaner to process enough lint cotton for efficient operation of the cotton gin, the feed assembly and feed works for each of the embodiments herein described are preferably able to feed at least 0.6 pounds of cotton lint per minute per inch of cylinder axial length. Preferably feed rates are in excess of 1.0 pound per inch per minute, which for an 80 inch long cylinder would result in a capacity of 80 pounds per minute, or about 4800 pounds an hour for a high capacity cotton gin lint cleaner.

Again referring to FIGS. 2 through 6, grid or mote bars 36 are mounted to the frame parallel the axes, and adjacent and along the first cylinder 10 by mounting brackets 37 at each end of the grid bars. The bars 36 have sharp grid bar edges 38 parallel the cylinder axes and proximate the moving saw teeth 16, preferably about 0.030 inches from the saw teeth. As the teeth 16 move the cotton layer beneath the grid bars, the layer is scrubbed against the edges 38. This somewhat linear disturbance of the cotton layer, in combination with centrifugal force and gravity, loosens trash from the cotton fibers in the layer. The trash is carried to a trash conveyor by gravity and air currents.

The lint cleaner of FIG. 2 further includes follow or downstream cylinder 40 mounted or journaled to the frame 12 for rotation about a follow or downstream axis that is parallel to the first axis. Surface 42 of the follow cylinder 40 extends along axially and radially of the follow axis, such that the follow cylinder surface 42 is adjacent and parallel the first cylinder surface 14.

Referring to the description of upstream and downstream terms above, the first cylinder 10 may also be referred to as an upstream cylinder that is upstream from the follow cylinder 40. Likewise, the follow cylinder 40 may also be referred to as a downstream cylinder that is downstream of the first or upstream cylinder 10.

Figures 4, 9:
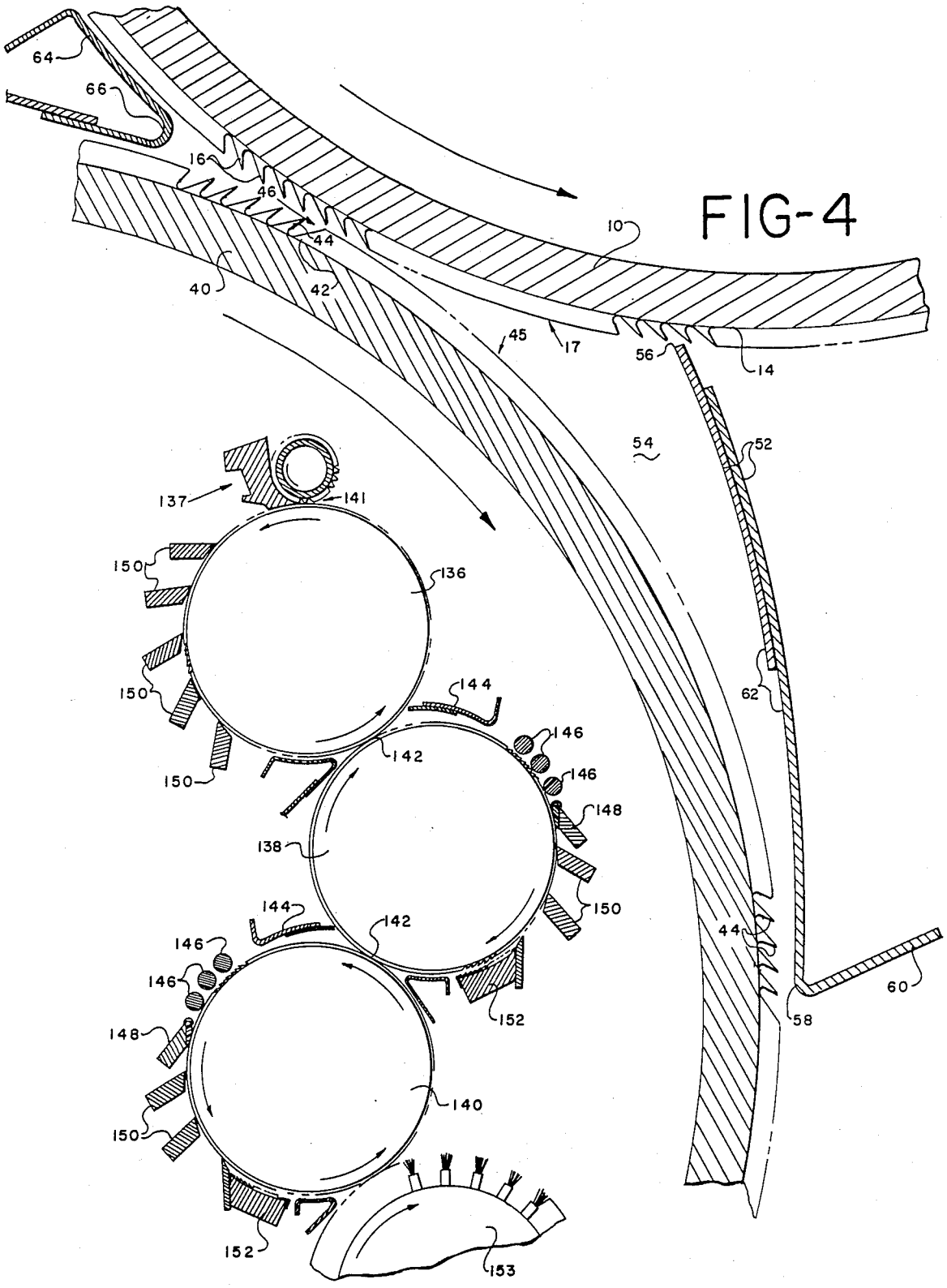
FIG. 4 is a section view of the saw pinch and deflector of the lint cleaner of FIG. 2.
FIG. 9 is a somewhat schematic side section view of a third embodiment of our invention having a plurality of saw cylinders.

A plurality of saw teeth 44 are attached to and spaced over the follow cylinder surface 42. The follow cylinder teeth 44 are preferably substantially the same in structure and method of attachment as the first cylinder teeth 16, with spirally wrapped saw band 45 on the follow cylinder 40. Thus, as shown in FIG. 4, the orientation of the cylinders and teeth is such that the saw teeth 16 and 44 of the two cylinders 10 and 40 are opposed and in close proximity lengthwise thereof along pinch point or saw pinch 46 between the cylinders.

Follow drive belt 48, connecting a motor (not shown) to follow drive pulley 50, axially attached to the follow cylinder 40, form follow or downstream drive means for rotating the follow cylinder about the follow axis counter to the rotation of the first cylinder 10.

The follow cylinder teeth 44 are preferably oriented or inclined in the direction of tooth movement when the follow cylinder 40 is rotated. The follow drive means also provides for rotating the follow cylinder 40 with respect to the first cylinder 10 such that the follow cylinder teeth 44 move faster than the first cylinder teeth 16 at the saw pinch 46.

We have determined that a speed ratio of 1.3 to 1 between a follow cylinder of sixteen inches diameter and a first cylinder of sixteen inches diameter is preferred for virtually complete transfer of fibers from the first cylinder. That is, at this speed ratio, almost no cotton fibers are carried on the first cylinder teeth past the saw pinch. However, at this speed ratio, the layer or batt of cotton fibers tends to be insufficiently engaged with the follow cylinder teeth to be carried on the follow cylinder surface downstream of the pinch point. In other words, if undeflected, the layer would shoot out away from between both cylinders.

Deflector 52 is adjacent and along the follow cylinder, parallel the axes. The deflector 52 forms downstream-tapered transfer chamber 54 above the follow cylinder teeth 44 immediately, or just, downstream of the saw pinch 46. The deflector 52 is mounted to the frame 12 by mounting brackets 53 at ends thereof.

The deflector 52 has an upstream edge 56 that is spaced substantially away from the follow cylinder teeth, parallel the axes and cylinder surfaces, and proximate the first cylinder teeth downstream of the saw pinch. The preferred spacing of the upstream edge 56, for the embodiment shown in FIG. 2 and described above, is about 1.5 inches, plus or minus about ⅛ inch.

The deflector has downstream deflector edge 58 that is substantially downstream from the upstream deflector edge on the follow cylinder surface, and that is parallel the axes and spaced away from but proximate the follow cylinder teeth. For the embodiment shown in FIG. 2, the edge 58 is spaced about 3/16 inch from the teeth 44. It is important that the downstream deflector edge 58 be spaced so that the layer is engaged and retained by the follow cylinder teeth.

Figure 3:
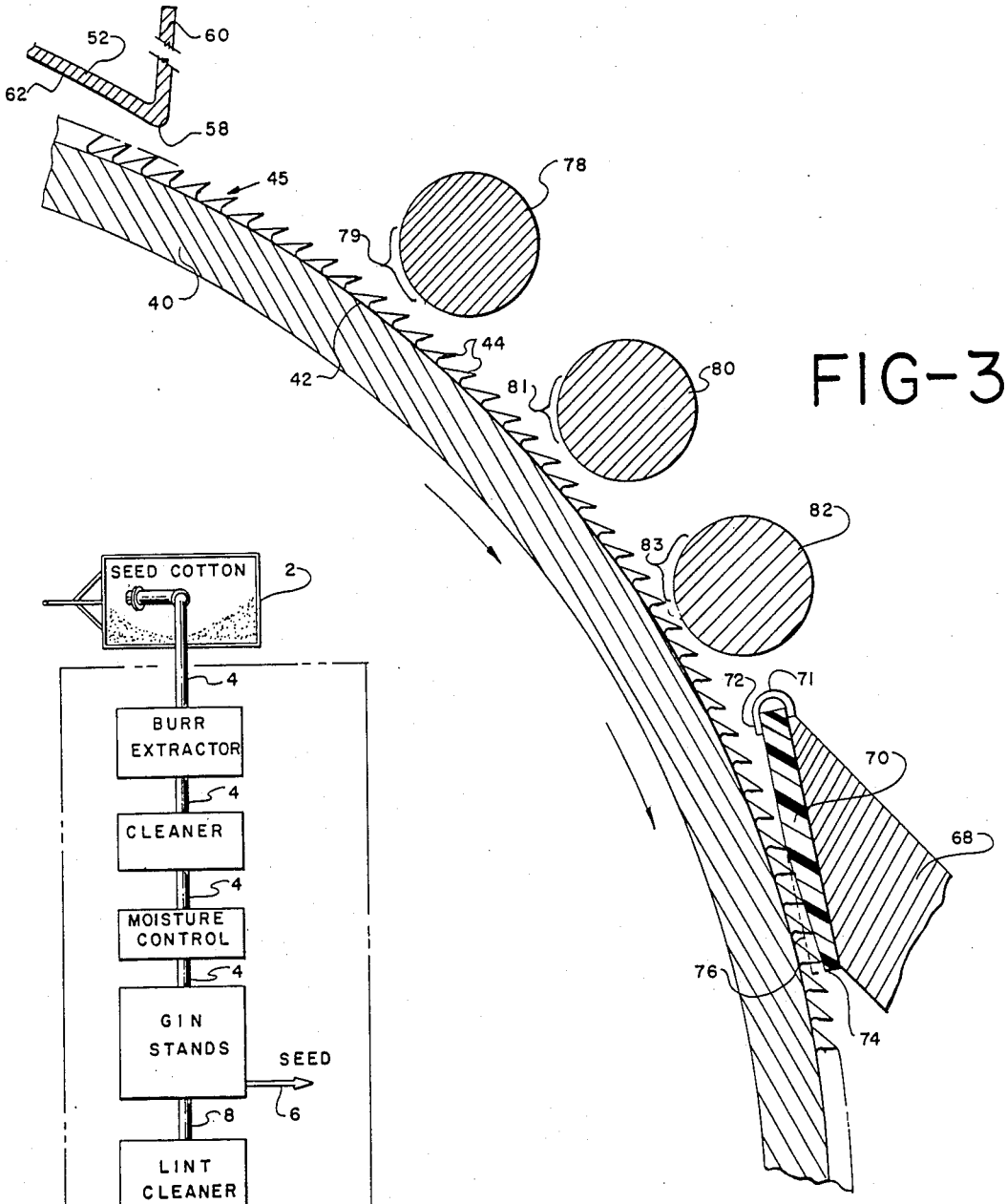
FIG. 3 is a section view of part of the lint cleaner of FIG. 2, showing the downstream edge of the deflector, the three blunt bars, and the seating bar.

Because the position of the dowmstream edge 58 is important, we prefer to incorporate a deflector flange 60, as shown in FIGS. 2, 3, and 4, to impart structural rigidity to the dowmstream edge 58.

Arcuate surface or radial inside slide face 62 of the deflector 52 extends from and connects the upstream edge 56 to the downstream edge 58. The arcuate surface 62 defines the downstream tapered transfer chamber 54 between the deflector and the downstream or follow saw cylinder 40.

We have determined that air flow created by the moving cylinder has a significant effect on the cotton layer during transfer between the cylinders. The slide face 62 is somewhat arcuate, concave, or radiused, and serves to direct the cotton layer and the air currents toward the follow cylinder teeth. The deflection of the air currents tends to form somewhat of a boundary layer that helps to keep the layer intact as it is directed to and engaged by the downstream cylinder teeth.

We have determined that for the sixteen inch saw cylinders of this embodiment, the shape of the slide face 62 shown in FIGS. 2 and 4 is the preferred shape for smooth deflection of the cotton layer and air currents at the relative cylinder speeds described above. Of course, changes in the shape of the slide face 62 may be necessary for saw cylinders of different diameters, speeds, or tooth densities, and would be within the scope of our invention.

We also prefer to place pinch guide 64 between the cylinders parallel the axes and opposite the saw pinch 46 from the deflector 52 as shown in FIG. 2. Guide edge 66 of the pinch guide 64 is notably rounded, as opposed to the sharp pointed structure disclosed in the prior art, to account for air flow.

The layer must be sufficiently seated to pass beneath the grid bar edges, typically spaced about 0.030 inches from the saw tooth tops. Seating is sufficiently accomplished for the first cylinder by the action of the feed assembly, which is well-known in the cotton gin lint cleaning art.

The stationary leading edge of the feed assembly, and the feed roller, which feeds a thick layer of cotton past the leading edge to the saw cylinder, are arranged such that the cotton fibers are pulled by the saw teeth away from the feed assembly across the leading edge. This resistance, or pulling, results in fully seating the cotton fibers in the teeth of the first cylinder. Unfortunately there is no comparable resistance available at the saw pinch or pinch point between the saw cylinders.

Thus, the layer engaged by the follow cylinder teeth after passing through the transfer chamber is ordinarily not sufficiently seated to permit the use of grid bars on the follow cylinder periphery, since the poorly seated layer would be deflected off of the follow cylinder by the edges 34 and into the trash disposal system, where valuable fiber would be lost.

Our invention provides for seating the cotton layer onto the follow cylinder teeth with a seating bar 68, preferably used in conjunction with one or more blunt or round bars spaced between the seating bar 68 and the deflector downstream edge 58.

Referring to FIG. 3, the seating bar 68 is positioned parallel the axes, adjacent and along the follow cylinder surface, and mounted to the frame 12 with mounting brackets 69 attached at ends thereof. Seating face 70 is attached to the seating bar 68 opposite the follow cylinder teeth 44. Seating clip 71 secures upstream edge 72 of the seating face to the bar 68.

The seating face 70 is inclined with respect to the teeth 44 such that the upstream seating edge 72 of the seating face 70 is parallel the axes and spaced proximate the follow cylinder teeth 44. The space or distance between the seating face 70 and the saw teeth 44 tapers or decreases downstream of the upstream seating edge 72. Downstream seating edge 74 of the seating face 70 is abutted against the follow cylinder teeth 42 such that the downstream seating edge 74 is cut by the tops of the saw teeth 44.

The seating face 70 is preferably constructed of material that is effaceable or that can be cut by or that is softer than the saw teeth, so that substantial damage or wear of the teeth will not occur. The spiral winding of the teeth on the cylinder will cause each tooth to cut its own clearance, and hence its own downstream seating edge 74.

In FIG. 3, the dotted line depicts the seating face before it was cut away by the saw teeth 44. The portion of the seating face outlined by the dotted line is clearance cut 76, which is exaggerated for illustrative purposes in FIG. 34. The cut 76 may vary along the length of the seating bar because of nonuniform tooth height.

Referring again to FIG. 3, blunt or round bars 78, 80 and 82 are parallel the axes, adjacent, and along the follow cylinder. The blunt bars 78, 80, and 82 are spaced between the deflector 52 and the seating bar 68, and have blunt surfaces or edges or faces 79, 81, and 83, respectively, thereon. The blunt faces are parallel the axes. The blunt bars are mounted to the frame 12 with mounting brackets 77 at each end thereof.

The blunt faces 79, 81 and 83 are spaced proximate the saw teeth. The blunt face 79 is more proximate the saw teeth than the downstream deflector edge 58. The blunt face 81 that is downstream of the blunt face 79 is more proximate the saw teeth than the blunt face 79. The blunt face 83 that is downstream of the blunt face 81 is more proximate the saw teeth than the blunt face 81. Each blunt face is disposed upstream and proximate the saw teeth, as shown in FIG. 3. This decreasing clearance between the blunt bars and the teeth serves to successively further engage the layer with the saw teeth as it moves downstream, in preparation for final seating by the seating bar 68.

It will be understood that other preseating structures than round bars could be used and still be within the scope of our invention, so long as the preseating structure used has a rounded or blunted face or surface that tapers downstream toward the saw teeth 44. For example, if space would permit, seating bars with inclined faces similar to seating face 70 spaced away from the teeth 44, or grid bars with rounded, blunted edges, could be used as blunt bars. Likewise, although three blunt bars are preferred, one, or two, or four or more blunt bars could be employed to advantage, as desired.

The spacings between the blunt bars, and the deflector, and the seating bar, are necessary to allow dispersal of the substantial air currents developed by rotation of the saw cylinders.

For the exemplary cylinders, diameters and tooth speeds described above, the structure, spacing, and clearances of the blunt bars shown in FIG. 3 are preferred.

We prefer to place two grid bars 84 and 86 downstream of the seating bar with somewhat sharp grid bar edges 88 and 90 parallel the axes and positioned proximate the follow cylinder teeth. The grid bars 84 and 86 are parallel the axes, adjacent and along the follow cylinder, and are similar in structure and function to the grid bars 36 described above. The grid bars 84 and 86 are mounted to the frame 12 by mounting brackets 85 and 87 respectively.

Downstream of the grid bars 84 and 86, we prefer to place combing bar 92 parallel the axes, adjacent and along the follow cylinder. The combing bar 92 is mounted to the frame 12 by mounting brackets 93 at each end thereof.

Figure 6:
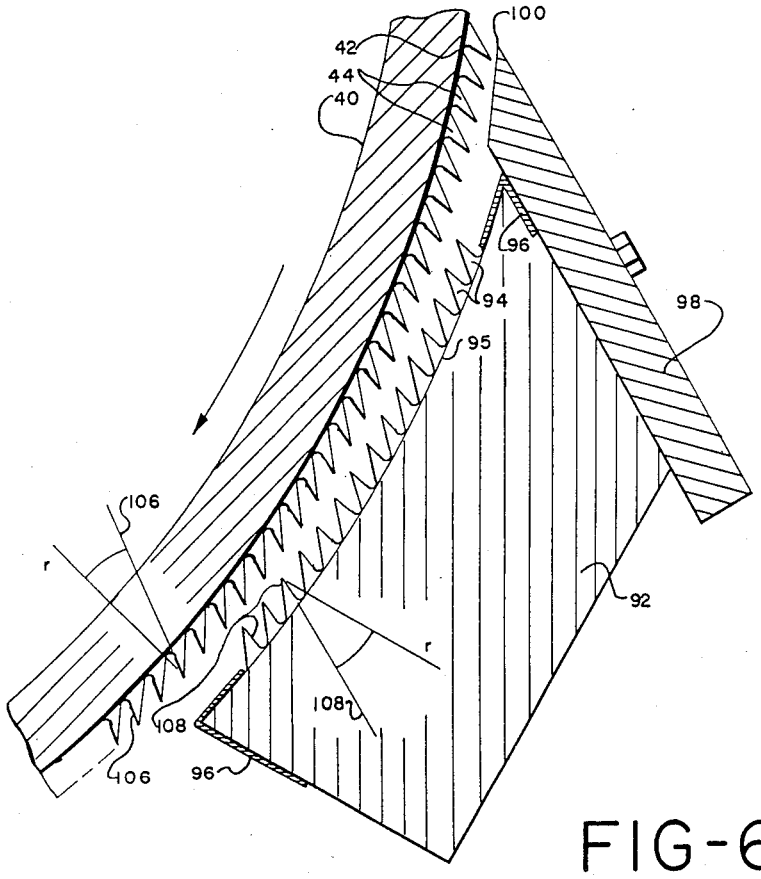
FIG. 6 is a section view of the combing bar on the follow cylinder of FIG. 2.

Referring to FIG. 6, the combing bar 92 has a plurality of combing teeth 94 attached thereto opposite and proximate the follow cylinder teeth, with the combing teeth 94 preferably being inclined opposite the direction of follow cylinder tooth movement.

The combing teeth 94 are preferably formed on somewhat short strips 94' of saw band similar to the long spirally wound saw band preferably used for the saw cylinders. The combing strips 94' are attached parallel in grooves cut in radiused combing face 95, and are secured with clips 96 attached to the combing bar 92. The combing teeth 94 are preferably inclined or oriented such that the combing tooth bands or strips 94' are somewhat transverse of the spiral wound saw bands 45. In other words, if from the perspective shown in FIG. 5, the follow cylinder saw bands are left handed wrapped about the follow cylinder, the combing tooth bands would be right hand inclined with respect to the follow cylinder bands.

Figure 5:
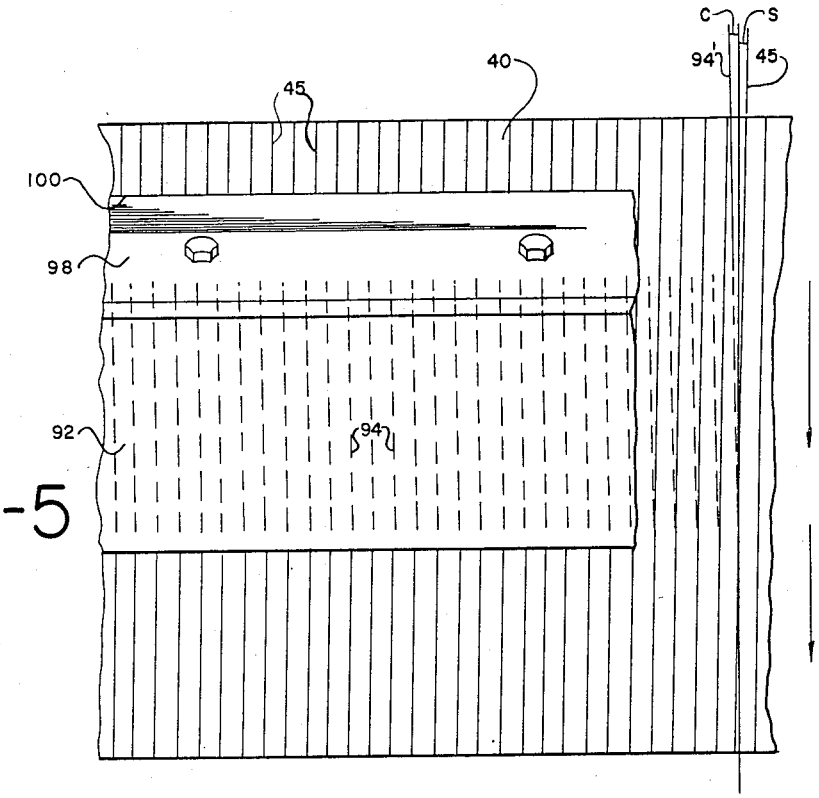
FIG. 5 is a somewhat schematic plan view of the combing bar on the follow cylinder of FIG. 2, showing the orientation of the saw and combing blades.

The angles of the combing and saw bands, somewhat schematically shown in FIG. 5, are slightly exaggerated for clarity. The dashed lines represent the combing bar bands or strips, while the solid lines represent the saw cylinder bands. It may be seen with the extensions of the combing tooth band 94' and of the saw tooth band 45, that the combing bar and saw cylinder bands are preferably oriented at the same opposite angles "c" and "s", respectively, to a line on the cylinder surface 42 normal to the follow axis, shown as a vertical line between lines 94' and 45 in FIG. 5. This orientation of the combing bar strips and saw cylinder bands is preferred for increased cleaning efficiency, but is not essential to the functioning of our invention.

It may be seen that as the cotton layer moves beneath the combing bar, the layer will be disturbed substantially at point locations by the combing teeth. Thus the action of the combing bar differs from the grid bars in that the combing bar primarily creates disturbances in the cotton layer at staggered points, whereas the grid bars primarily disturb the cotton layer along a line normal to the direction of movement thereof.

The point disturbances of the layer also tend to align the cotton fibers therein. The alignment, in combination with the disturbances, centrifugal force, and gravity loosens the trash or foreign matter from the layer. We believe that the combination of the actions of the linear disturbances by the grid bars and the point disturbances by the combing teeth enhance the cleaning effect of these devices to a greater extent than the sum of their cleaning effects when used separately.

We prefer to use the same tooth density of about 48 to 72 points per square inch for the combing bar as for the saw cylinders.

We have also determined that it is advantageous and preferable to place a grid bar immediately upstream of the combing teeth. This grid bar is shown in the drawings and described herein as trash bar 98 attached to an upstream side of the combing bar 92. Peripheral space about the follow cylinder surface 42, normally required for the grid bar mounting brackets such as 85 or 87, is saved by attaching the trash bar 98 directly to the combing bar.

The trash bar has a somewhat sharp trash edge 100 spaced proximate the saw teeth, parallel the axes, and immediately upstream of the combing teeth 94. The trash edge 100 functions as a grid bar edge immediately upstream of the combing teeth.

As described above in the Summary of the Invention section, transferring and inverting the layer betwen two adjacent, counter-rotating saw cylinders exposes both sides or surfaces of the layer to cleaning devices. For example, the grid bars 36 in FIG. 2 clean one side of the layer facing away from the upstream cylinder, and the layer is inverted during transfer. Additional cleaning takes place during transfer at the saw pinch. Then, the grid bars 84 and 86 and the combing bar 92 clean the other side of the layer, now facing away from the downstream cylinder. Thus, in addition to providing more peripheral area for the use of cleaning devices, the use of two or more adjacent saw cylinders permits cleaning of both sides of the layer. We also believe the blunt and seating bars perform some cleaning.

We prefer to employ an air flow and gravity system to remove trash from the periphery of the saw cylinders in the form of trash ducts 102 with intake ports 103 therein. The ducts 102 are positioned around the grid bars and combing bar on the first and follow cylinders. Gravity, and air forced through the ducts 102, carries trash or foreign matter removed from the cotton lint away from the cylinders and into air conveyor 104, as indicated by the arrows in FIG. 2. Of course, other trash and foreign matter material handling systems, such as belt or screw conveyors, are well-known in the art and could be used in connection with our invention.

We prefer to use saw bands for the saw cylinders that have teeth with forward faces inclined about 36° to normal of the straight band bottom, (FIG. 6) similar to those used in cotton gin lint cleaners prior to our invention. Saw tooth forward faces 106 and combing tooth forward faces 108 are shown in FIG. 6. The forward faces 106 are angled at about 36° to a radius of the follow cylinder 40. The saw tooth face 106 and combing tooth face 108 and their angles to the radius "r" are geometrically shown in FIG. 6. The 36° angle will change somewhat when the saw bands are curved to fit in the combing bar face 95 or wrapped around the saw cylinders 10 and 40. However, the slightly changed angle does not substantially affect the functioning of the teeth, to the extent that we have been able to determine.

The optimum angle for the combing tooth forward face has not been established but it is believed to be between 36° (as shown) and minus 45°. The minus 45° angle is achieved by mounting the bands in the combing bar backwards.

Doffing cylinder 109 rotates about a doffing axis parallel to the saw cylinder axes and adjacent the follow cylinder 40. The doffing cylinder 109 forms doffing means for doffing the cotton layer from the follow cylinder at a doffing pinch between the cylinders 40 and 109. The cleaned lint is then conveyed or transported to the packaging or pressing phase of the cotton gin operation. Doffing brushes 112 preferably extend to the follow cylinder teeth, such that the doffing brushes flick the cotton fibers from the cylinder into lint duct 105 surrounding the doffing cylinder downstream of the doffing pinch. The lint duct 105 connects to the lint handling system 8. The point at which the doffing brushes 112 extend nearest the saw tooth tops is herein described as the doffing pinch.

The doffing cylinder 109 is rotated about a doffing axis parallel to the first and follow axes by doffing drive means in the form of doffing belt 111 connecting a motor (not shown) to doffing pulley 110 axially attached to the doffing cylinder 109. The doffing cylinder rotates counter to the follow cylinder and the doffing brushes move faster than the follow cylinder teeth, as is well-known in the art regarding doffing of the lint from a single saw cylinder lint cleaner.

It will be understood that the doffing cylinder shown is merely exemplary, and that other such doffing means may be employed and still be within the scope of our invention. For clarity, a complete doffing cylinder section is shown in FIG. 7, and only partially shown in FIGS. 2, 8, 9 and 10.

Referring to FIG. 2, it may be seen that the saw pinch and the doffing pinch are each radially more than 180° from the feed pinch and saw pinch, respectively. This results in the staggered, or zig-zag arrangement of the first, follow, and doffing cylinders, as is apparent in referring to FIG. 2. This staggered arrangement exposes more of the periphery of the saw cylinders in the path of the layer for the installation and utilization of cleaning devices such as the grid bars and combing bar previously described.

As described above, the utilization of the deflector 52 of our invention disturbs the air flow and deflects the cotton layer toward the follow cylinder teeth 44. The result of this disturbance is that very small amounts of cotton fibers remain on the first saw cylinder past the saw pinch 46. These fibers are poorly seated, and would be removed from the first cylinder by centrifugal force, gravity, and the trash duct air flow to be carried off with trash and foreign matter, and lost.

We prefer to install lint fiber return 113 adjacent and longitudinal of the first cylinder 10 downstream of the pinch point 46. Nozzles 114 extend from the duct 113 with open ends of the nozzles 114 proximate the first cylinder surface 42 and fluidly communicated with the duct 113 interior. Retention plate 115 is curved or radiused and substantially covers the first cylinder surface between the deflector upstream edge 56 and the nozzles 114, and prevents the poorly seated fibers from being prematurely removed by the trash removal system.

As shown in FIG. 2, the fiber return 113 extends through the frame 12 and to intake duct 23' of the lint cleaner shown in FIG. 2. The intake duct 23' is similar to the condenser intake duct 23 of FIG. 7. Air flow through the intake duct 23' produces suction on the fiber return 113, causing the lint fibers proximate the nozzles 114 to be sucked into the condenser intake duct 23' through the return 113, to be recycled into the batt or layer fed to the first cylinder 10 by the feed assembly 29.

Figure 8:
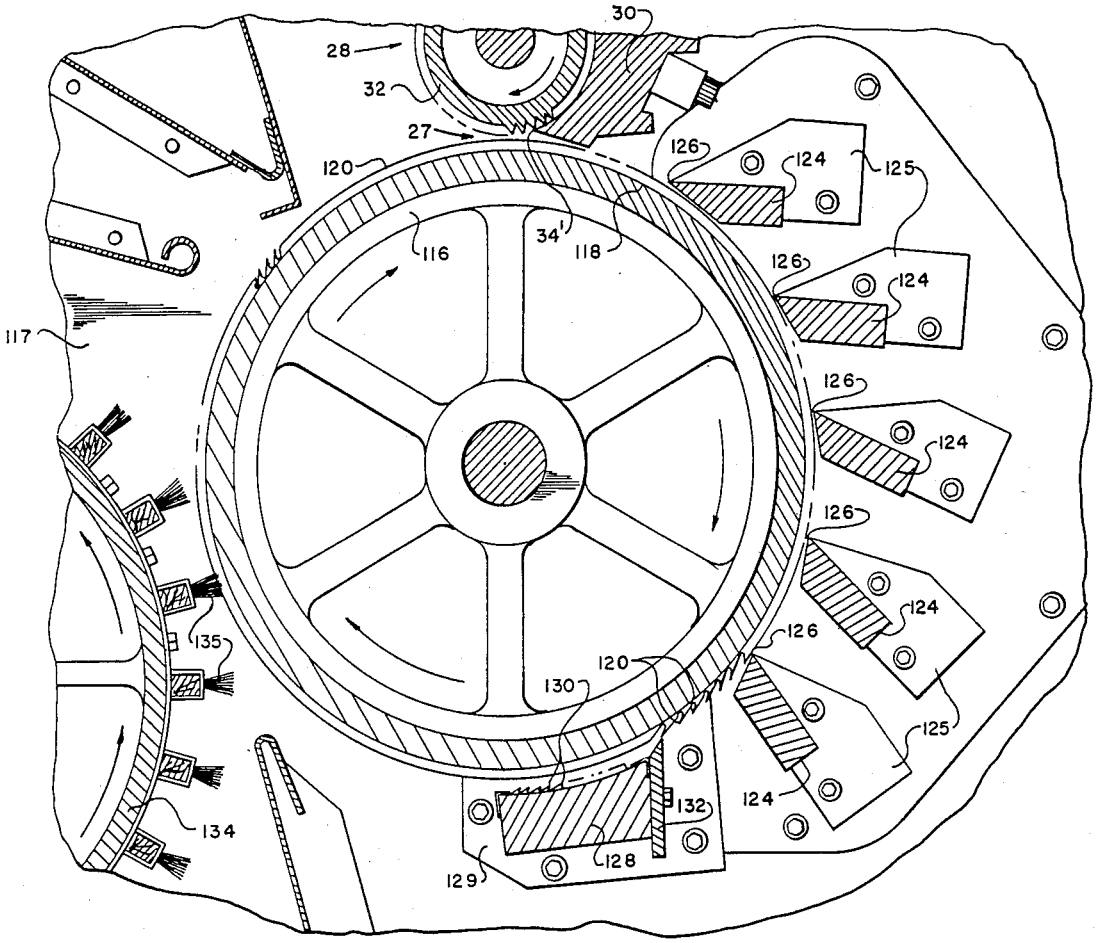
FIG. 8 is a section view of the saw cylinder of the lint cleaner shown in FIG. 7.

Referring to FIGS. 7 and 8, a second alternate embodiment of our invention may be seen to include saw cylinder 116, substantially the same as the first cylinder 10 described above. The saw cylinder 116 is mounted or journaled to frame 117 for rotation about a saw cylinder axis. Saw cylinder surface 118 extends parallel and along the saw axis. A plurality of saw cylinder teeth 120 are attached to and spaced over the saw cylinder surface 118, preferably in the same form as the first cylinder teeth 16 described above.

Drive means for rotating the saw cylinder about the saw axis are not shown but are preferably substantially the same as that described above for the first embodiment of FIGS. 2 through 6. The saw cylinder teeth are inclined in a direction of tooth movement during saw cylinder rotation, and feed assembly 28 is mounted proximate, adjacent, and along the saw cylinder 116. The feed assembly 28 forms feed means for feeding a substantially continuous layer of cotton along the saw cylinder surface 118. A feed pinch is between the saw cylinder 118 and the feed assembly 28.

At least one, and preferably five or more, grid bars 124 are mounted parallel the axis and adjacent and along the saw cylinder 116. The grid bars 124 are spaced apart downstream of the feed pinch, with grid bar edges 126 of the grid bars 124 being parallel the axis and proximate the saw cylinder teeth. The grid bars 124 function, and are positioned and formed, as described above for grid bars 36, 84 and 86. Similarly, the grid bars 124 are mounted to the frame 117 with mounting brackets 125. FIG. 8 provides a sectional view of the saw cylinder 116 and the cleaning structure mounted thereon.

Combing bar 128 is spaced immediately downstream of the grid bars 124 and is parallel the axis and adjacent and along the saw cylinder 116. The combing bar 128 is mounted to the frame 117 by mounting brackets 129 at each end thereof. A plurality of combing teeth 130 are attached to the combing bar 128 opposite and proximate the saw teeth 120. The combing bar 128 and combing teeth 130 are preferably of substantially the same form as the combing teeth described above for the first embodiment. As with the first embodiment, we prefer to use a tooth density of about 48 or 50 tooth points per square inch on both the saw cylinder 116 and the combing bar 128.

We also prefer to attach trash bar 132 to the front of the combing bar 128 to function as described above with regard to the trash bar 98. Trash duct 131 surrounding the saw cylinder 116 periphery functions like the trash ducts 102 described above, and is connected to trash conveyor 133 for disposing of trash and foreign matter removed by the lint cleaner.

Doffing cylinder 134 is also mounted for rotation about a doffing axis that is parallel to the saw axis. The doffing cylinder is similar to doffing cylinder 110 described above and is not restricted to the brush type.

Therefore, it may be seen that the embodiment shown in FIG. 7 incorporates the novel features and advantages of our combing bar invention on a single saw cylinder lint cleaner. This embodiment of our invention is particularly suited to the conversion of downstream lint cleaners in a series of two or more existing cotton gin lint cleaners to function according to our invention.

Referring to FIG. 9, which is somewhat schematic, a third embodiment of our invention may be seen to incorporate three saw cylinders serially oriented in the zig-zag or staggered pattern described more particularly above with regard to the first embodiment (FIG. 2) by spacing the pinches more than 180° apart. First cylinder 136 is mounted for rotation about a first axis, and is fed a layer of cotton by feed assembly 137, similar to the feed assemblies shown and described in connection with FIGS. 2 and 7. Drive means (not shown), similar to those described for the first embodiment, rotate the first cylinder 136.

Follow cylinder 138 is mounted for rotation about a follow axis. Follow cylinder 140 is mounted for rotation about another follow axis. Each cylinder 136, 138, and 140, has a surface parallel to and radial of the first and follow axes, respectively, and is similar to the saw cylinder of the first embodiment.

The feed assembly 137 feeds the layer of lint cotton across a feed pinch 141 between the feed assembly 137 and the first cylinder 136. The feed assembly forms feed means for feeding a substantially continuous batt or layer of lint along the first or upstream cylinder. The first and follow axes are all parallel, and the cylinders 136, 138 and 140 are adjacent with saw pinches 142 therebetween. An appropriate frame (not shown) supports cylinders and other structures mounted.

A deflector 144, three blunt bars 146, and a seating bar 148 are mounted and positioned downstream of each saw pinch 142, substantially as described above with regard to the first embodiment. Drive means (not shown) for each of the follow cylinders, similar to those described for the follow cylinder of the first embodiment, provide for rotation of each follow cylinder counter to the rotation of the cylinder immediately upstream therefrom. The drive means for the follow cylinders also provides for movement of the teeth on each follow cylinder faster than, preferably 1.3 times the speed of movement of the saw teeth on the cylinder immediately upstream therefrom. The first cylinder saw bands are wrapped at a spacing of 8 per inch resulting in 48 saw points per square inch. The follow cylinders may be wrapped simularly or up to 12 per inch resulting in 72 saw points per square inch.

It may be seen in FIG. 9 that each of the saw pinches 142 are more than 180° from its upstream or preceeding feed or saw pinch to expose more peripheral surface of the cylinders 136, 138, and 140. We prefer to install grid bars 150 and combing bars 152, both substantially as described above for the first embodiment, along the peripheries of the saw cylinders. We prefer that the combing bars have the same point per square inch as the cylinders they face.

Of course, doffing cylinder 153 is positioned adjacent the last follow cylinder of the series of cylinders, for this embodiment shown as the follow cylinder 140. It will be understood that additional follow cylinders could be interposed after the follow cylinder 140 and before the doffing cylinder 153 to increase the number of saw cylinders with cleaning structure thereon for additional cleaning capacity.

It may be advantageous to install more than one combing bar on a saw cylinder, or to install a combing bar on the first cylinder 136, as well as on the follow cylinders 138 and 140, as shown. For specific details of such combing bar mounting on the first cylinder, reference is made to the second embodiment shown in FIGS. 7 and 8, where the saw cylinder 116 and the positioning of the grid bars 124 and the combing bar 128 thereabout is substantially the same as the preferred structure when the embodiment shown in FIG. 9 includes a combing bar on the first saw cylinder 136.

It may be seen that utilization of multiple saw cylinders permits cleaning of a side of the lint layer more than once.

Referring to the discussion of upstream and downstream cylinders in regard to the first embodiment (FIG. 2), it may also be seen that the first cylinder 136 for this embodiment (FIG. 9) may also be referred to as an upstream cylinder 136 upstream from the follow cylinders 138 and 140. Likewise the follow cylinder may be referred to as downstream cylinder 138 downstream from first cylinder 136, and as upstream cylinder 138 upstream from the follow cylinder 140. Therefore, it will be understood that the terms upstream and downstream cylinders are dependent on the position of the referenced cylinder. The terms "upstream" or "downstream" are not restricted to the first or follow cylinders, respectively, in a series of multiple cylinders.

It will be understood that the combined action of the adjacent saw cylinders across the saw pinch and the deflector functions as feed means for feeding a substantially continuous layer of the lint along a saw cylinder. When the counter-rotating adjacent saw cylinders, deflector, blunt bars and seating bar are combined they function as feed means for feeding a substantially continuous layer of lint along a saw cylinder and seating the layer in the teeth of the saw cylinder.

We believe that as the number of cylinders increases, the potential for damaging cotton fibers in the layer increases. Therefore, although our transfer method and apparatus could be advantageously employed on cotton gin lint cleaners having more than two saw cylinders, we believe that the two saw cylinder lint cleaners described in FIG. 2, and below in FIG. 10, are preferable, and will provide satisfactory results in cleaning foreign matter from cotton gin lint.

Figure 10:
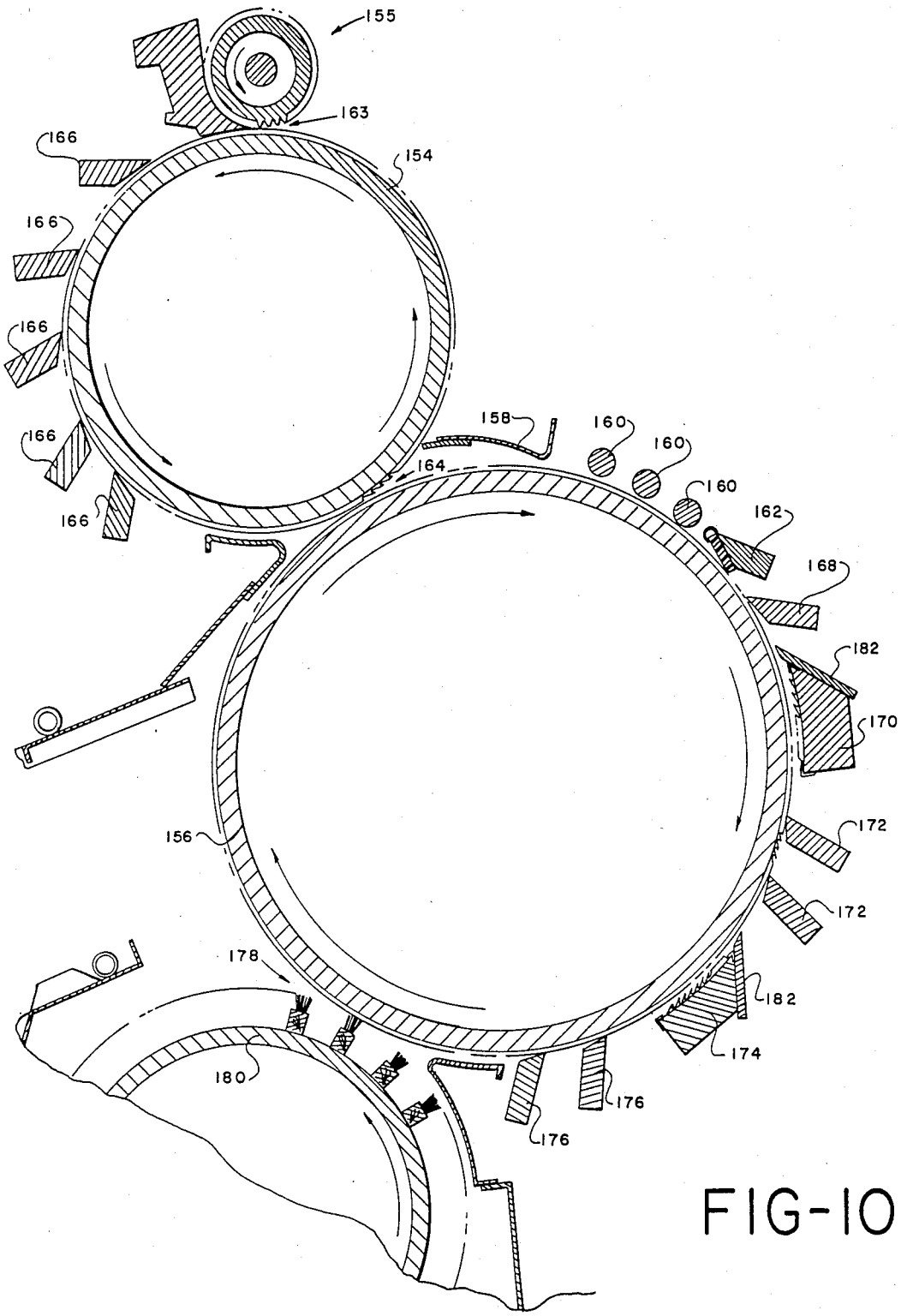
FIG. 10 is a somewhat schematic side section view showing a variation of the embodiment shown in FIG. 2 with a follow cylinder larger in diameter than the first cylinder and more grid and combing bars.

Referring to FIG. 10, which is somewhat schematic, another embodiment of our invention, a variation of the first embodiment, incorporating two saw cylinders, includes first saw cylinder 154 mounted for rotation about a first axis, and larger diameter follow saw cylinder 156 adjacent thereto and mounted for rotation about a follow axis. The spokes and internal structure of the cylinders have been omitted for clarity. Feed assembly 155 forms feed means for feeding a substantially continuous layer of cotton along the first cylinder 154.

Each of the saw cylinders 154 and 156 has drive means connected thereto (not shown) for rotating the cylinders counter each other, similar to the respective drive means disclosed above in the first embodiment. Each of the saw cylinders has a plurality of saw teeth attached to and spaced over a surface thereof, substantially as described in connection with the first embodiment of FIG. 2 above. The drive means for the follow cylinder 156 rotates the cylinder 156 so that the teeth thereof move 1.3 times the speed of the first cylinder teeth. An appropriate frame (not shown) supports the mounted cylinders and structure positioned thereabout.

The first cylinder 154 and the follow cylinder 156 could also be referred to as upstream cylinder 154 and downstream cylinder 156.

The teeth of both cylinders 154 and 156 are inclined in the direction of tooth movement of the cylinder to which they are attached. The first cylinder 154 is preferably about 16 inches in diameter for this embodiment, and the follow cylinder 156 is preferably about 24 inches in diameter.

Grid bars 166 are spaced about the periphery of the first cylinder downstream of feed pinch 163 between the feed assembly 155 and the cylinder 154, substantially as described above for the first embodiment.

Deflector 158, blunt bars 160, and seating bar 162 are preferably substantially the same as those described for the first embodiment above, and are each spaced adjacent and along the follow cylinder 156 downstream of saw pinch 164 between the saw cylinders.

Upstream grid bar 168 is spaced downstream of the seating bar 162. Upstream combing bar 170 is spaced downstream of the grid bar 168. Intermediate grid bars 172 are spaced downstream of the combing bars 170. Downstream combing bar 174 is spaced downstream of the intermediate bars 172. Downstream grid bars 176 are spaced downstream of the downstream combing bar 174, and upstream of doffing pinch 178. The doffing pinch 178 is between doffing cylinder 180 and the follow cylinder 156.

The grid bars 168, 172, and 176, and the combing bars 170 and 174, are of substantially the same spacing from the saw cylinder, form and function as those described above in connection with the first embodiment. To provide two additional grid bars, the combing bars 170 and 174 also preferably have trash bars 182, similar to trash bar 98, attached thereto.

Thus, by using a follow cylinder of larger diameter, the number of cleaning devices, such as grid bars and combing bars, according to our invention may be increased and arranged as needed. This also avoids stressing the cotton fibers due to multiple transfers to other follow saw cylinders.

We believe that the alignment of the cotton fibers by the teeth on the combing bars 170 and 174 enhances the cleaning effect of the intermediate and downstream grid bars 172 and 176. Thus using the grid bars downstream of the combing bars provide novel and unexpected results not accomplished with such grid bars in the prior art. Such unexpected and surprising results are also derived by combining the grid bars and combing bars on saw cylinders in almost any arrangement.

It will be understood that the relationship between the diameters of the saw cylinders shown for this embodiment is not critical and that almost any cylinder diameters may be employed so as to provide the desired peripheral area for installation and utilization of our various cleaning devices therealong.

Thus it may be seen that our invention for cleaning cotton gin lint allows the utilization of a single enhanced saw cylinder, or more than one saw cylinder with an optimal transfer speed ratio between cylinders. Our invention for more than one saw cylinder adequately seats the cotton layer on the follow cylinder to permit utilization of variously disposed grid and combing bars. We believe our invention will significantly benefit cotton producers who will now be able to market cleaner, higher grade stripper cotton.

Many parts which are well-known have not been shown or described because they are not part of this invention. For example, the brackets 53, 85, 87 and 93 are adjustable, but this has not been shown.

The embodiments shown and described above are only exemplary. We do not clain to have invented all the parts, elements or steps described. Various modifications can be made in the construction, material, arrangement, and operation, and still be within the scope of our invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

2 cotton trailer
4 seed cotton handling system
6 seed handling system
8 cotton lint handling system
10 upstream saw cylinder
12 frame
14 surface
16 sawteeth
17 saw band
18 first drive belt
20 first drive pulley
22 condensor (FIG. 7)
23 intake duct (FIG. 7)
23' intake duct (FIG. 2)
24 doffing assembly (FIG. 7)
26 compression rollers (FIG. 7)
27 feed pinch (FIG. 8)
28 feed assembly (FIG. 7)
29 feed assembly (FIG. 2)
30 feed plate (FIG. 8)
31 feed plate (FIG. 2)
32 feed roller (FIG. 8)
33 feed roller (FIG. 2)
34 feed edge (FIG. 2)
34' feed edge (FIG. 8)
35 feed pinch (FIG. 2)
36 grid bars
37 mounting brackets
38 grid bar edges
40 downstream saw cylinder
42 surface
44 saw teeth
45 saw band
46 saw pinch
48 follow drive belt
50 follow drive pulley
52 deflector
53 bracket
54 tapered chamber
56 upstream deflector edge
58 downstream deflector edge
60 deflector flange
62 slide face
64 pinch guide
66 guide edge
68 seating bar
69 mounting bracket
70 seating face
71 seating clip
72 upstream seating edge
74 downstream seating edge
76 clearance cut
77 mounting bracket
78 blunt bar
79 blunt face
80 blunt bar
81 blunt face
82 blunt bar
83 blunt face
84 grid bar
85 mounting bracket
86 grid bar
87 mounting bracket
88 grid bar edge
90 grid bar edge
92 combing bar
93 mounting bracket
94 combing teeth
94' combing strips
95 combing bar face
96 clips
98 trash bar
100 trash bar edge
102 trash ducts
103 intake ports
104 air conveyor
105 lint duct
106 saw tooth faces
108 combing tooth faces
109 doffing cylinder
110 doffing pulley
111 doffing belt
112 doffing brushes
113 fiber return duct
114 nozzles
115 retention plate
116 saw cylinder
117 frame
118 saw cylinder surface
120 saw cylinder teeth
124 grid bars
125 mounting brackets
126 grid bar edges
128 combing bar
129 mounting brackets
130 combing teeth
131 trash duct
132 trash bar
133 trash conveyor
134 doffing cylinder
135 doffing brushes
136 upstream cylinder
137 feed assembly
138 upstream or downstream cylinder
140 downstream cylinder
141 feed pinch
142 saw pinches
144 deflectors
146 blunt bars
148 seating bars
150 grid bars
152 combing bars
153 doffing cylinder
154 upstream cylinder
155 feed assembly
156 downstream cylinder
158 deflector
160 blunt bars
162 seating bar
163 feed pinch
164 saw pinch
166 grid bars
168 upstream grid bar
170 upstream combing bar
172 intermediate grid bars
174 downstream combing bar
176 downstream grid bars 178 doffing pinch
180 doffing cylinder
182 trash bars

We claim as our invention:

1. A system for cleaning lint cotton including the steps of:

a. receiving seed cotton into a gin building,
b. transporting the seed cotton to gin stands, then
c. separating the seeds and the lint cotton of the seed cotton with the gin stands, then
d. conveying the lint cotton to a feeder of a lint cleaner,
e. feeding a layer of lint cotton, having more than 5% foreign matter content, to a rotating saw cylinder of the lint cleaner, having a length, at a rate of at least 0.6 pound of lint cotton per minute per inch of the saw cylinder length,
f. engaging the layer with a plurality of saw teeth on the saw cylinder
g. moving the layer on the saw teeth beneath a plurality of stationary grid bars, each having an elongated edge transverse and proximate the saw tooth movement, thereby
h. disturbing the lint fibers in the layer with the edge of the grid bars, thus
i. loosening foreign matter from the layer;

wherein the improvement comprises the following steps after the above:

j. disengaging most of the layer from the saw cylinder at a pinch between the saw cylinder and a device downstream of the grid bars for disengaging lint fibers from the saw cylinder,
k. moving remaining lint fibers not disengaged from the saw cylinder at the pinch downstream of the pinch on the teeth of the saw cylinder,
l. suctioning the remaining lint fibers from the saw cylinder into a lint return duct adjacent the saw cylinder,
m. returning the remaining lint fibers in the lint return duct to the feeder of the lint cleaner, and
n. combining the remaining lint fibers with lint cotton conveyed to the feeder from the gin stands, while
o. conveying the lint fibers disengaged at the pinch to a bale press, and then
p. pressing the lint fiber conveyed to the press into dense bales.

2. The invention as defined in claim 1 including all of the limitations a. through p. with the addition of the following limitations:

q. performing the following steps before the "disengaging" step "j." above,
r. moving the layer on the same saw teeth beneath a plurality of combing teeth, each having a point opposite and proximate the saw teeth, thereby
s. disturbing and aligning the lint fibers in the layer with the points of the combing teeth, thus
t. loosening foreign matter from the layer.

3. The invention as defined in claim 1 including all of the limitations a. through p. with the addition of the following limitations:

q. performing the "disengaging" step "j." by
r. counter-rotating the structure in the form of a downstream cylinder having a length, with teeth thereon adjacent to and downstream of the saw cylinder,
s. moving the downstream cylinder teeth past the pinch between the cylinders faster than the saw cylinder teeth move past the pinch,
t. disengaging most of the layer from the saw cylinder teeth at the pinch with the faster movement of the downstream cylinder teeth, thereby
u. moving a substantial disengaged portion of the layer tangentially of the cylinders at the pinch through a transfer chamber, then
v. deflecting the disengaged layer onto the downstream cylinder teeth, and then
w. engaging the cotton fibers of the disengaged layer with the downstream cylinder teeth,
x. inverting said layer during transfer from the upstream cylinder to the downstream cylinder.

4. A lint cleaner in a cotton gin for processing lint cotton with greater than 5% foreign matter content, having a. saw cylinder mounted for rotation about a cylinder axis extending along a cylinder length,
b. a plurality of saw teeth attached to and spaced axially and radially over the saw cylinder,
c. drive means on the lint cleaner for rotating the saw cylinder,
d. the cylinder saw teeth inclined in the direction of tooth movement during cylinder rotation and
e. feed means for feeding a substantially continuous layer of the lint cotton to the saw teeth along the cylinder length at a feed pinch therebetween,
f. the feed means feeding at least 0.6 pounds of lint cotton per minute per inch of cylinder length;
g. the cotton gin also including
h. receiver means for receiving seed cotton,
i. transport means for transporting the seed cotton from the receiver means to
j. gin stand means for separating seeds and lint cotton of the seed cotton,
k. lint conveyor means, for conveying the lint cotton having greater than 5% foreign matter content from the gin stand means to the lint cleaner, and for conveying the lint cotton from the lint cleaner to
l. press means for pressing the lint cotton into dense cotton bales;

wherein the improvement comprises in combination with the above:

m. structure for disengaging most of the lint fibers from the saw cylinder at a pinch therebetween,
n. a lint return duct having a mouth extending along and adjacent the saw cylinder, downstream of the pinch,
o. the lint return duct being fluidly connected to the lint conveyor means for conveying the lint cotton from the gin stand to the lint cleaner.

5. The invention as defined in claim 4 including all of the limitations a. through o. with the addition of the following limitations:

p. at least one combing bar mounted parallel the axis and along the saw cylinder,
q. a plurality of combing teeth attached to the combing bar, each having a combing tooth point opposite and in close proximity to the saw cylinder teeth, with
r. the combing bar concave.

6. A lint cleaner in a cotton gin for processing lint cotton with greater than 5% foreign matter content, having a. an upstream saw cylinder mounted for rotation about an upstream cylinder axis extending along an upstream cylinder length,
b. a plurality of saw teeth attached to and spaced axially and radially over the upstream cylinder, c. upstream drive means on the lint cleaner for rotating the upstream cylinder, d. the upstream cylinder saw teeth inclined in the direction of tooth movement during upstream cylinder rotation and e. feed means for feeding a substantially continuous layer of the lint cotton to the saw teeth along the upstream cylinder length at a feed pinch therebetween, f. the feed means feeding at least 0.6 pounds of lint cotton per minute per inch of upstream cylinder length;

g. the cotton gin also including h. receiver means for receiving seed cotton, i. transport means for transporting the seed cotton from the receiver means to j. gin stand means for separating seeds and lint cotton of the seed cotton, k. lint conveyor means, for conveying the lint cotton having greater than 5% foreign matter content from the gin stand means to the lint cleaner, and for conveying the lint cotton from the lint cleaner to l. press means for pressing the lint cotton into dense cotton bales;

wherein the improvement comprises in combination with the above:

m. a downstream saw cylinder mounted downstream of the upstream saw cylinder for rotation about an axis parallel to said upstream cylinder, extending along a downstream cylinder length, n. a plurality of saw teeth attached to and spaced over the downstream cylinder, o. downstream drive means for rotating the downstream cylinder counter to the rotation of the upstream cylinder with the downstream cylinder teeth moving faster than the upstream cylinder teeth, p. the downstream cylinder saw teeth inclined in the direction of tooth movement during downstream cylinder rotation, q. the saw teeth of the cylinders opposed in close proximity along a saw pinch therebetween, and r. a deflector mounted along the downstream cylinder, parallel the axes, and downstream of the saw pinch, s. an upstream edge of the deflector parallel to the axes, proximate the upstream cylinder teeth, and spaced away from the downstream cylinder teeth, t. a downstream edge of the deflector parallel to the axes and proximate the downstream cylinder teeth, and u. an arcuate, concave surface of the deflector connecting the upstream and downstream deflector edges and defining an arcuate, downstream tapered transfer chamber between the deflector and the downstream saw cylinder, v. a lint return duct having a mouth extending along and adjacent the upstream saw cylinder, downstream of the saw pinch, w. the lint return duct being fluidly connected to the lint conveyor means for conveying the lint cotton from the gin stand to the lint cleaner, x. a plurality of grid bars, mounted parallel the axes and adjacent at least one of the saw cylinders with y. an edge of each grid bar in close proximity to the saw cylinder teeth and extending the length of each.

* * * * *